US009808082B1

(12) United States Patent
Nelson

(10) Patent No.: US 9,808,082 B1
(45) Date of Patent: Nov. 7, 2017

(54) FOLDING ROTARY SIT-INSIDE DESK

(71) Applicant: Theodor Holm Nelson, Sausalito, CA (US)

(72) Inventor: Theodor Holm Nelson, Sausalito, CA (US)

( * ) Notice: Subject to any disclaimer, the term of this patent is extended or adjusted under 35 U.S.C. 154(b) by 0 days.

(21) Appl. No.: 15/491,836

(22) Filed: Apr. 19, 2017

(51) Int. Cl.

| | |
|---|---|
| ***A47B 11/00*** | (2006.01) |
| ***A47B 83/02*** | (2006.01) |
| ***A47B 13/08*** | (2006.01) |
| ***A47B 13/00*** | (2006.01) |

(52) U.S. Cl.
CPC ..... *A47B 83/02* (2013.01); *A47B 11/00* (2013.01); *A47B 13/003* (2013.01); *A47B 13/088* (2013.01); *A47B 2083/025* (2013.01)

(58) Field of Classification Search
CPC ..... A47B 83/02; A47B 13/003; A47B 13/088; A47B 11/00; A47B 2083/025; B65G 2812/14; A47G 23/08
USPC ..... 52/65; 108/27, 22, 94–96, 139, 141; 198/346, 803.16; 248/347.1, 521, 522
See application file for complete search history.

(56) References Cited

U.S. PATENT DOCUMENTS 55,677 A * 6/1866 Lance ..... A47B 11/00 108/94
2,447,072 A * 8/1948 Jones ..... B65G 29/00 108/22
2,622,724 A * 12/1952 Slama ..... B08B 9/42 198/803.16
3,004,571 A * 10/1961 Gerbrandt ..... A47B 11/00 108/139
3,180,483 A * 4/1965 Johnston ..... B65G 29/00 198/803.16
3,347,369 A * 10/1967 Conlon ..... B65G 29/00 198/803.16
3,437,057 A * 4/1969 Wulff ..... A47G 23/08 108/22
3,647,287 A * 3/1972 Schwind ..... A61B 3/18 108/103
3,706,471 A * 12/1972 Shimosawa ..... A47B 83/02 297/158.1
3,792,296 A * 2/1974 Lefebvre ..... B65G 29/00 198/803.16
4,114,541 A * 9/1978 Weddendorf ..... A47B 11/00 108/139
4,237,796 A * 12/1980 Gordon ..... A61B 3/18 108/103
5,950,503 A * 9/1999 Amendolea ..... B23P 21/006 74/813 C
6,868,754 B2 * 3/2005 Eix ..... A47G 33/04 108/22
2013/0198960 A1 * 8/2013 Angott ..... A61B 5/702 5/622

* cited by examiner

*Primary Examiner* — Janet M Wilkens
(74) *Attorney, Agent, or Firm* — Intellectual Property Venture Group; Raymond E. Roberts

(57) ABSTRACT

A desk (10, 10*a*, 10*b*) having a top section (14) including a central hole (12) wherein a user of the desk may sit and a gap (26) where they may enter. The top section has multiple sub-sections (20*a-c*) that assemble so the top section is substantially round and forms a top side whereupon objects may be placed on the desk. A central section (16) includes multiple uprights (30, 54) each having one or more wheels (46, 58) upon which the top section rotatably rests when the desk is assembled.

18 Claims, 7 Drawing Sheets

FIG. 2a
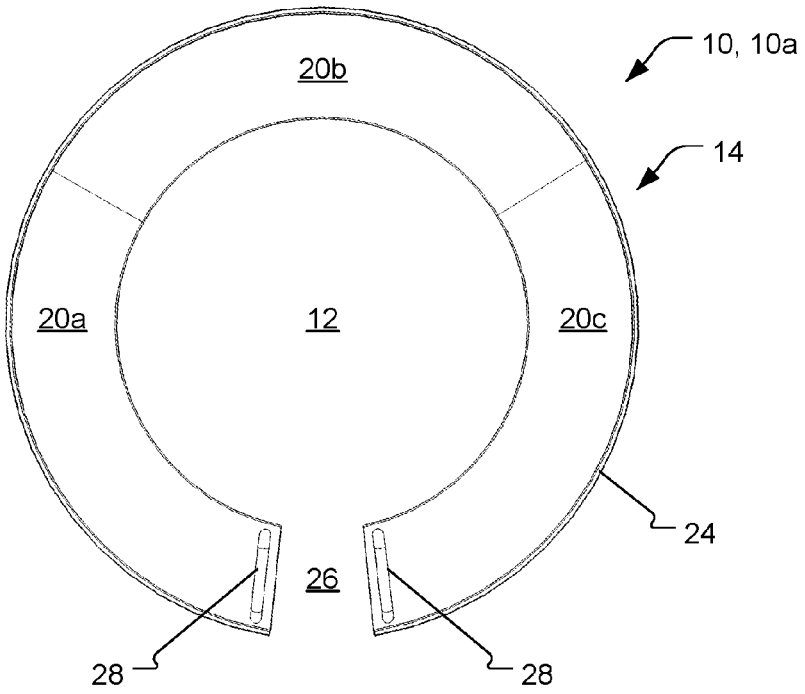
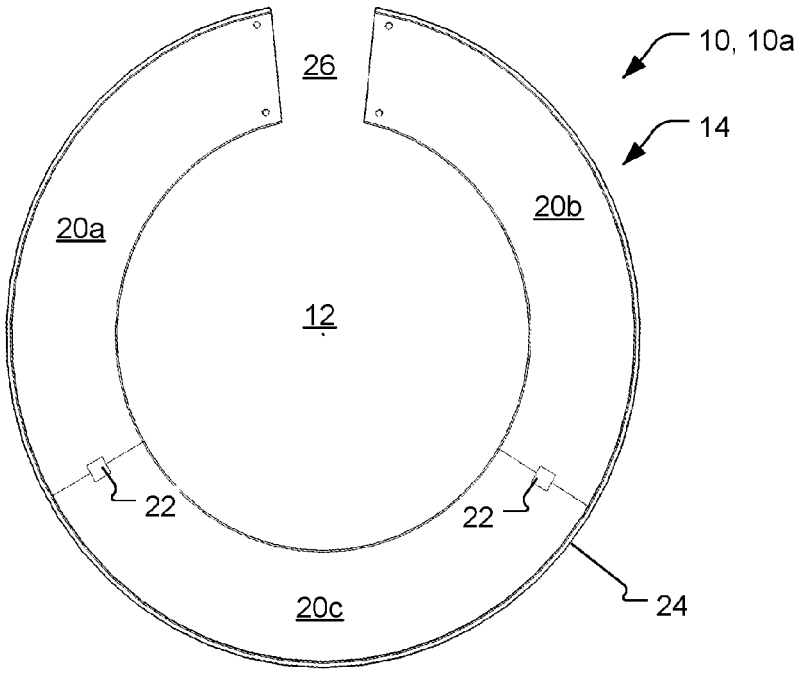
FIG. 2b

FOLDING ROTARY SIT-INSIDE DESK

CROSS-REFERENCE TO RELATED APPLICATIONS

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

COPYRIGHT NOTICE AND PERMISSION

This document contains some material which is subject to copyright protection. The copyright owner has no objection to the reproduction with proper attribution of authorship and ownership and without alteration by anyone of this material as it appears in the files or records of the Patent and Trademark Office, but otherwise reserves all rights whatsoever.

BACKGROUND OF THE INVENTION

Technical Field

The present invention relates generally to horizontally supported planar surfaces, and more particularly to desks that can rotates about a vertical axis.

Background Art

A desk, sometimes also termed a "bureau" is a piece of furniture with a substantially flat work surface. Desks are widely used in a schools, home, and the like for academic or domestic activities, such as reading and writing. Of particular present interest is the use of desks in business environments, such as reception areas and offices. Such desks are used for professional or domestic activities, again such as reading and writing, and especially for supporting equipment such as telephone, intercom units, and computers. The top side of a desk may also be used as a place to store frequently referenced documents or to keep a supply of frequently need forms.

From the preceding it can be gathered that the top of a desk has many potentially competing uses. On a conventional desk these uses may especially compete because of the inherent limitation of how much of the desk top a user may easily reach. Conventional desks are rectangular or L-shaped, and this limits the reachable desktop area.

BRIEF SUMMARY OF THE INVENTION

Accordingly, it is an object of the present invention to provide a rotary sit-inside desk.

Briefly, one preferred embodiment of the present invention is a desk. A top section has a central hole wherein a user of the desk may sit and a gap where they may enter into the central hole. The top section includes multiple sub-sections that assemble such that the top section is substantially round with a flat top side whereupon objects may be placed on the desk. A central section (16) includes a plurality of uprights each having one or more wheels upon which the top section rotatably rests when the desk is assembled.

Briefly, another preferred embodiment of the present invention is an improved desk of the type having a top section that includes one or more sub-sections, a central section that includes multiple uprights that support the sub-sections by having the top section rest upon the central section, and a base section that includes multiple baseplates that support the uprights of the central section. The improvement comprises the top section having a central hole wherein a user of the desk may sit and a gap where they may enter into the central hole, and where the sub-sections provide the top section with a shape substantially round horizontally and with a flat top side whereupon objects may be placed on the desk. The improvement further comprises the uprights in the central section each having one or more wheels upon which the top section rotatably rests when the desk is assembled.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE SEVERAL VIEWS OF THE DRAWING(S)

The purposes and advantages of the present invention will be apparent from the following detailed description in conjunction with the appended figures of drawings in which:

FIG. 1 is a perspective view of a first embodiment of a desk in accord with the present invention;

FIGS. 2*a-b* are top and bottom views of the top section of the desk in FIG. 1;

Figure 6A:
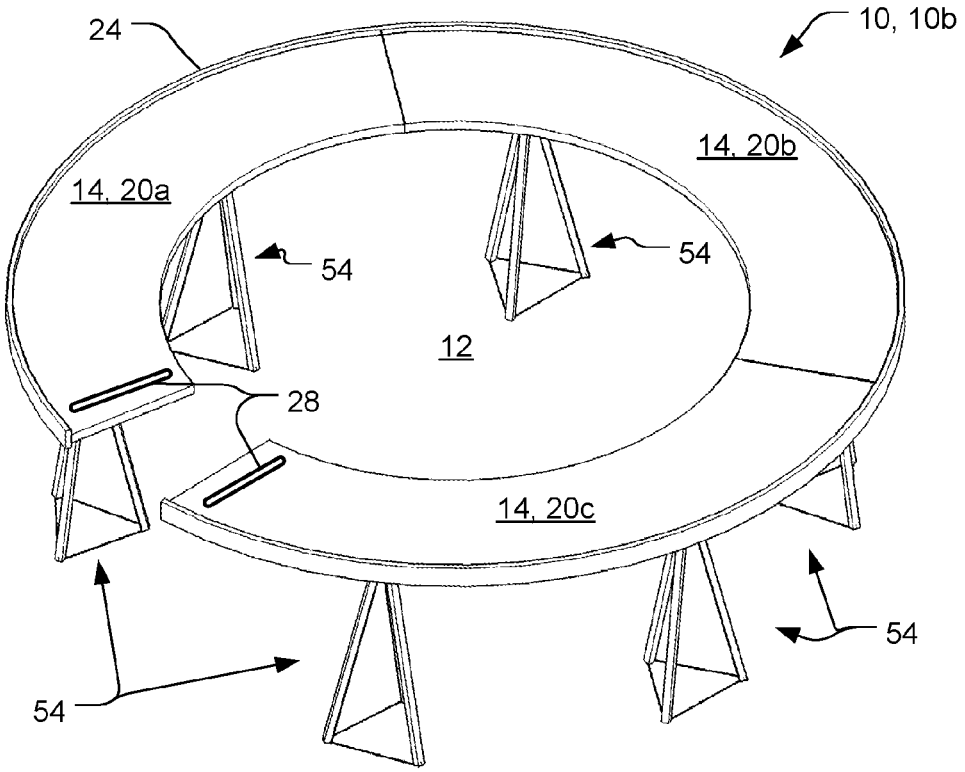
Figure 6B:
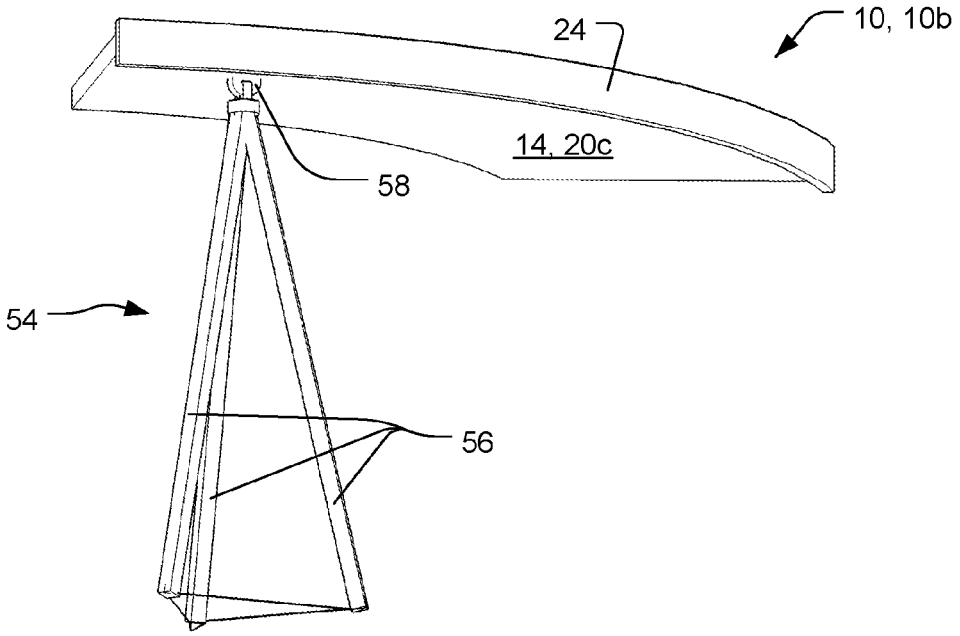
Figure 7A:
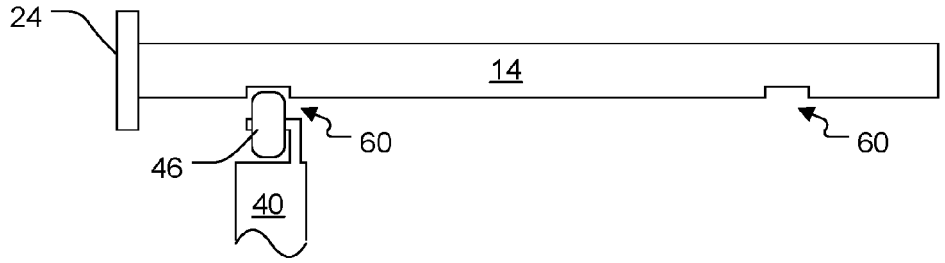
Figure 7B:
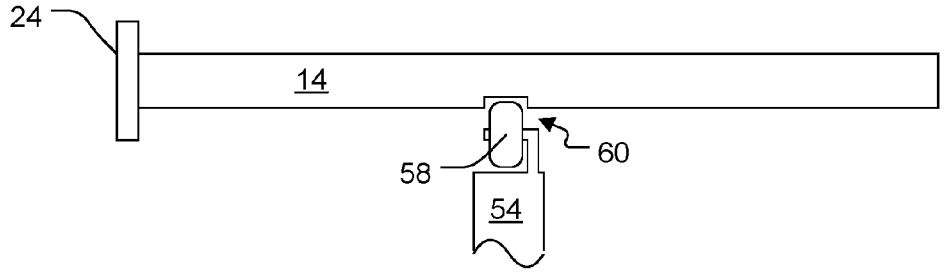
Figure 8:
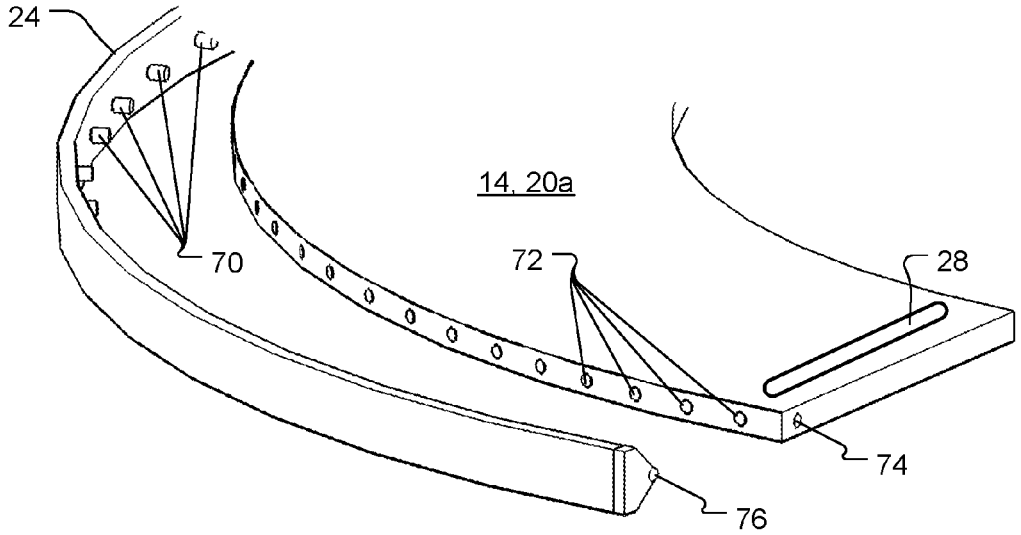

FIGS. 6*a-b* are, respectively, a top perspective view and a partial bottom perspective view of a second embodiment of a desk that is also in accord with the present invention;

FIGS. 7*a-b* are a partial cross-sectional views showing an example of grooves in a desk; and FIG. 8 is a partially exploded view of a sub-section of a desk.

In the various figures of the drawings, like references are used to denote like or similar elements or steps.

DETAILED DESCRIPTION OF THE INVENTION

A preferred embodiment of the present invention is a folding rotary sit-inside desk. As illustrated in the various drawings herein, preferred embodiments of the invention are depicted by the general reference character 10.

Figure 1:
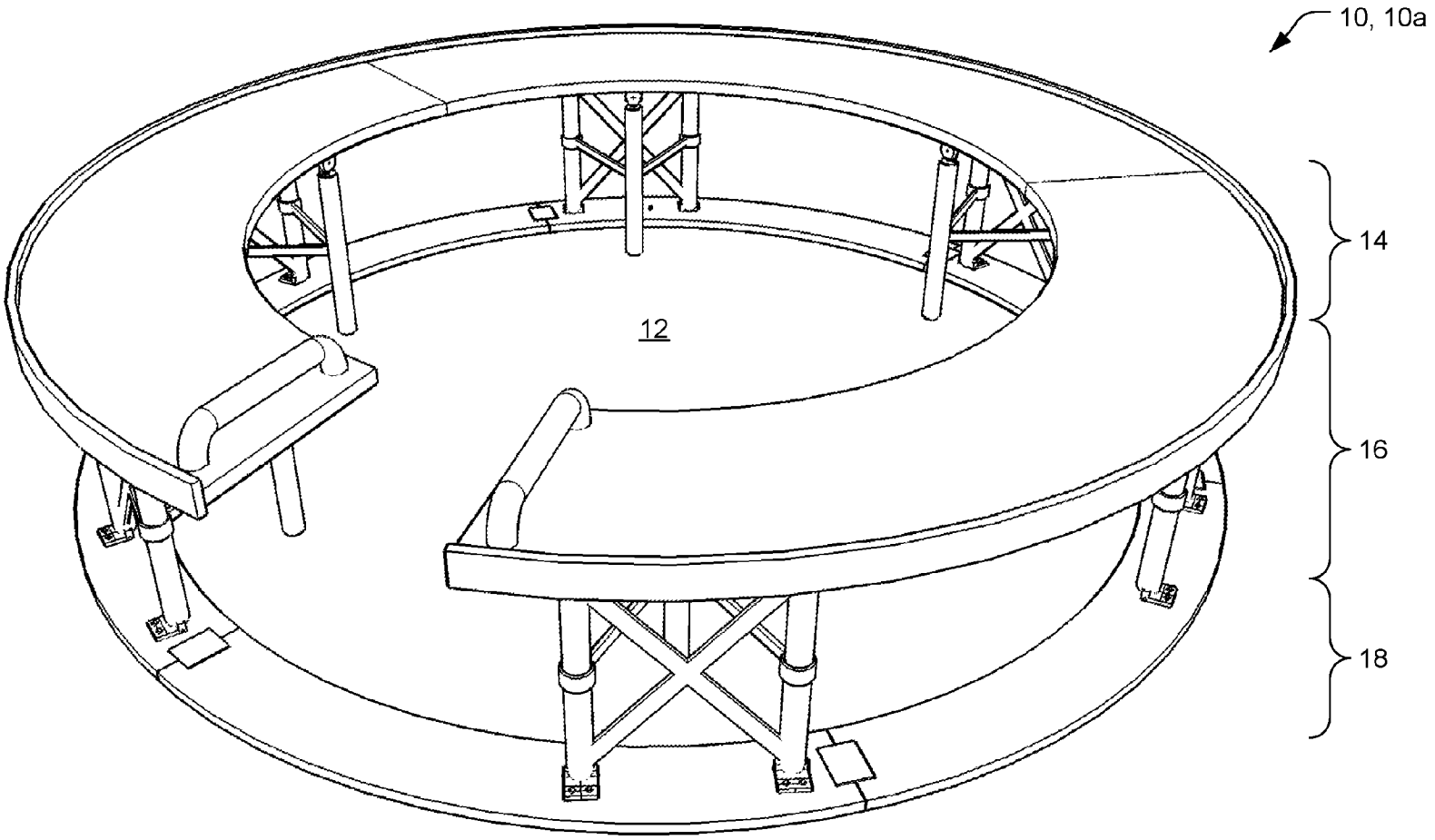

FIG. 1 is a perspective view of a first embodiment of a desk 10*a* in accord with the present invention (generically, a desk 10 for all embodiments discussed herein). Common to all embodiments of the desk 10 is a circular shape with a central hole 12 in the middle (an annulus) where a user sits. The embodiment of the desk 10*a* in FIG. 1 can be viewed as having three major sections, a top section 14, a central section 16, and a base section 18.

FIGS. 2*a-b* are top and bottom views of the top section 14 of the desk 10*a* in FIG. 1. The top section 14 here has three flat sub-sections 20*a-c* that are held together when the desk 10*a* is assembled, using easily connectable cleats 22 (FIG. 2*b*).

A flange 24 is provided at the outer periphery of the top section 14 and the three sub-sections 20*a-c*. The flange 24 optionally extends above and, here, necessarily extends below the sub-sections 20*a-c* (see e.g., FIG. 1). The flange 24 is preferably, but not necessarily, one piece that is separable from the sub-sections 20*a-c* and which can rolled up when the desk 10*a* is disassembled (see also FIG. 8). This runs somewhat counter to a goal of making a desk 10 that has a minimum number of generally flat pieces when disassembled, but is offset against a goal of stiffening an overall assembled desk 10.

A gap 26 is provided in the top section 14, for entry and egress of a user to the central hole 12. If desired, an optional flip-up or other type of door can be supplied to fill this gap 26. Such doors are common in the art of desks and counters and therefore not shown here.

Adjacent to the gap 26, optional endpieces 28 can be provided on the top side of the top section 14, as shown. These can generally resemble handles, and may be used to rotate the top section 14 (as described presently).

Collectively the above-ward extending flange 24 and the endpieces 28 can act as walls to keep things from falling off of the desk 10*a*.

Figure 3:
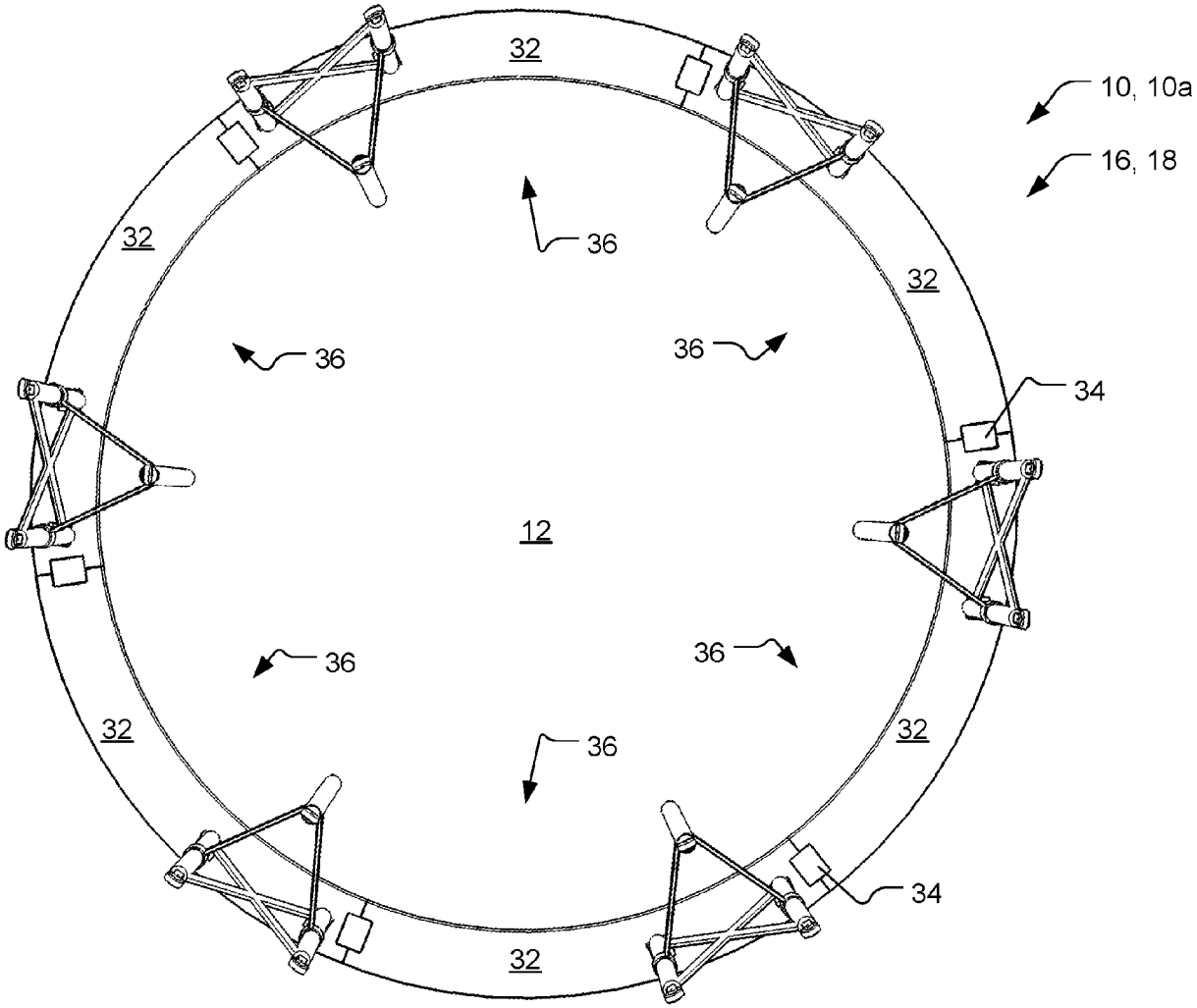
FIG. 3 is a top view of the central section and the base section of the desk, that is of the desk with the top section removed.

FIG. 3 is a top view of the central section 16 and the base section 18 of the desk 10*a*, that is of the desk 10*a* with the top section 14 removed. Here it can be seen that the central section 16 includes six uprights 30, and that the base section 18 includes six baseplates 32. Similar to how the cleats 22 secure the top section 14 together when the desk 10*a* is assembled, easily connectable clamps 34 are used to secure the baseplates 32 together when the base section 18 of the desk 10*a* is assembled. To minimize tripping, the baseplates 32 can be ⅛" beveled steel plates, painted black. Between each pair of uprights 30 is a user entrance point 36 (where the gap 26 in the top section 14 can be rotated to coincide with the respective entrance point 36).

Figure 4:
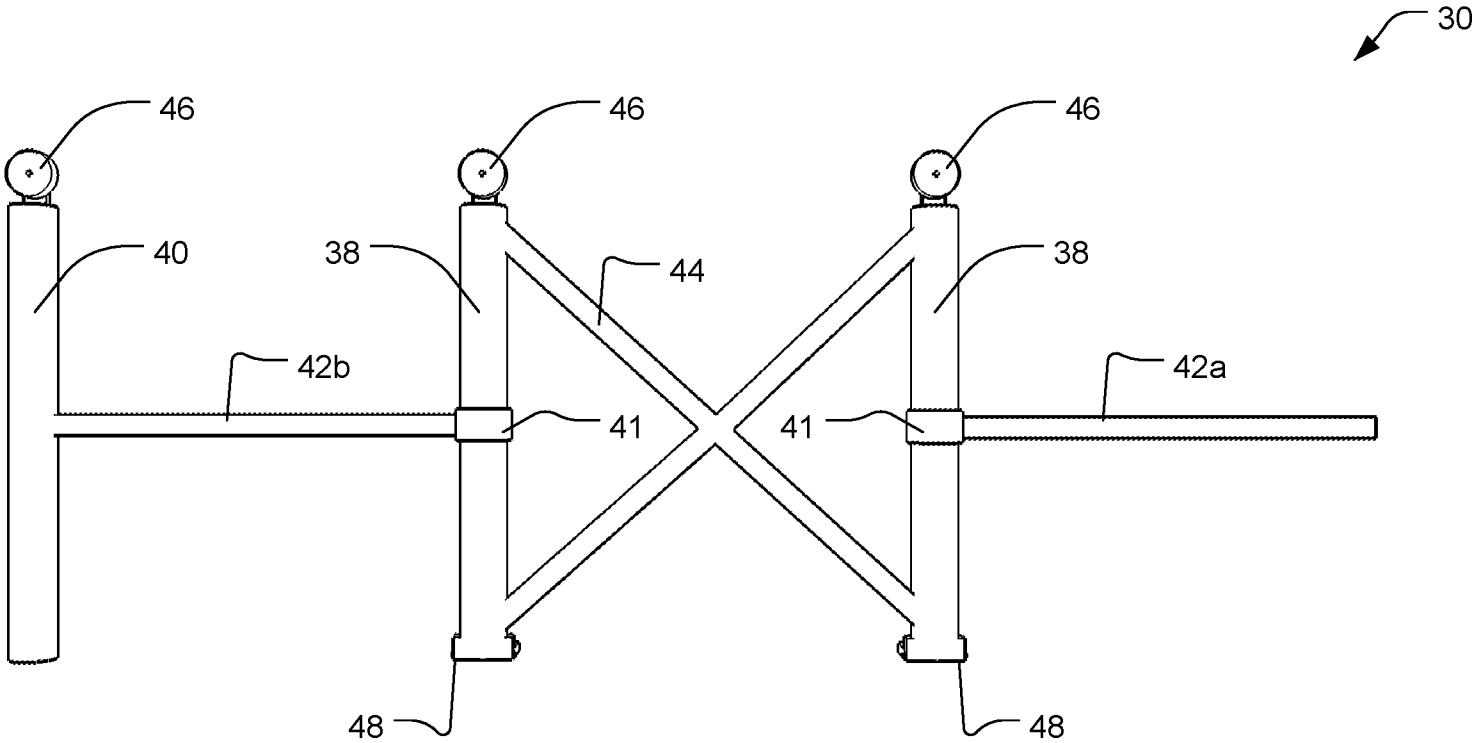
FIG. 4 is a front view of an upright, taken when the desk is disassembled.

FIG. 4 is a front view of an upright 30 (only), taken when the desk 10*a* is disassembled. As can be seen, the upright 30 includes two outer poles 38, one inner pole 40, two horizontal braces 42*a-b*, and a cross brace 44. The poles 38, 40 each have wheels 46, and the two outer poles 38 each have hinges 48. Many parts of the upright 30 can be welded steel, and yet still permit the upright 30 to be folded flat. For instance, the cross brace 44 can be permanently welded, and the end opposite the swivel tube or sleeve portion of the horizontal brace 42*b* can be permanently welded to the inner pole 40.

Figure 5:
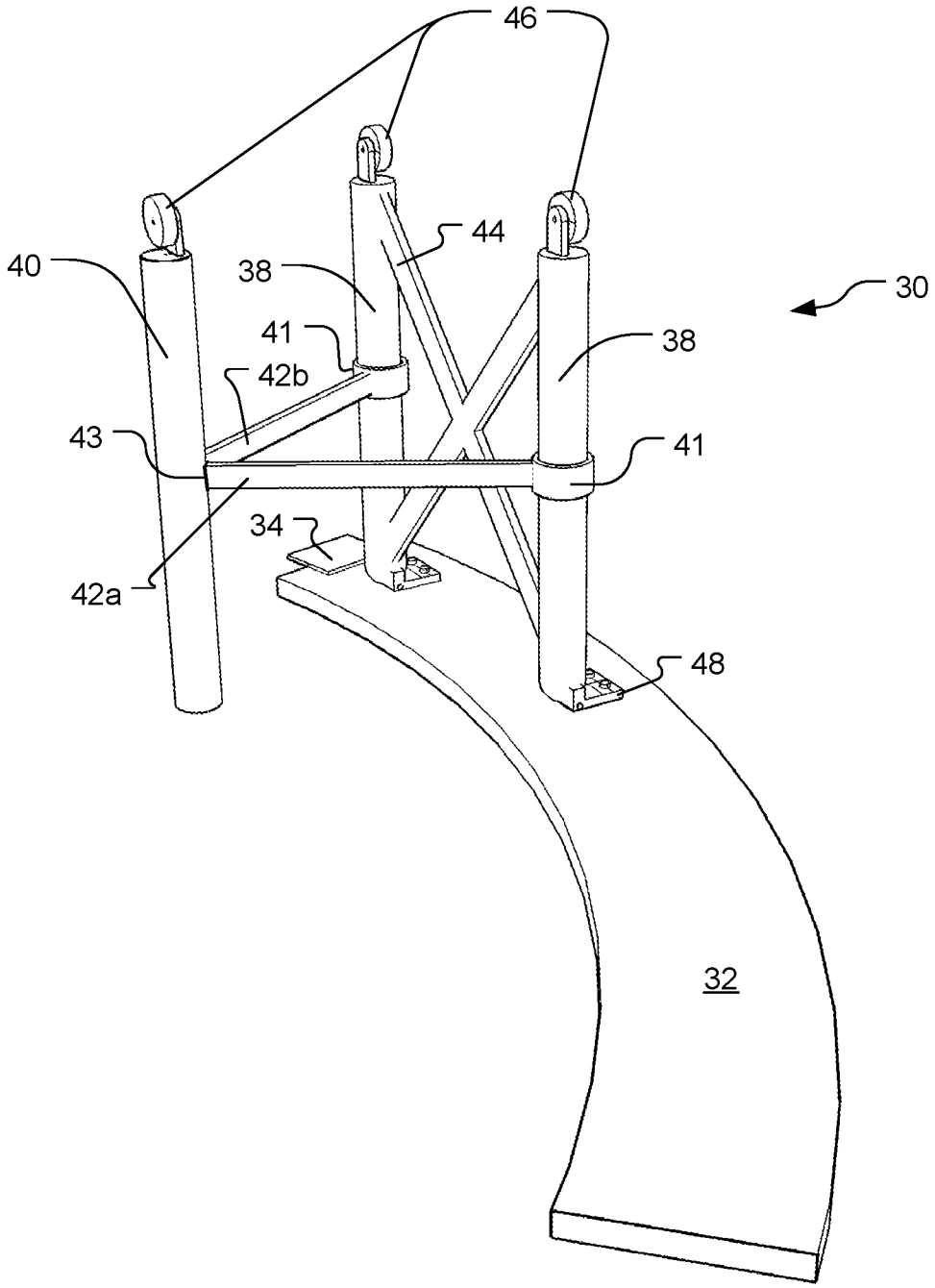
FIG. 5 is a perspective view of an upright and a baseplate assembled together.

FIG. 5 is a perspective view of an upright 30 and a baseplate 32 assembled together. This figure schematically shows how the uprights 30 hingeably attach to the baseplates 32. Together with FIG. 3 it can now be appreciated how six of the assemblies in FIG. 5 can be connected together to form the central section 16 and the base section 18 of the desk 10*a*. With reference again to FIG. 1, it can now also be appreciated how the assembled top section 14 can be placed atop the wheels 46 of the uprights 30 in the assembled central section 16, which in turn are connected to and resting on the baseplates 32 in the assembled base section 18. Once assembled in this manner a user may easily rotate the desk 10, 10*a* around quickly, giving them access to papers, tools, open books, etc.

In FIGS. 4-5 particular attention should be paid to the two horizontal braces 42*a-b* and how they attach to the poles 38, 40. One end of the horizontal brace 42*a* (the right end in FIG. 5) is rotatably attached to one of the outer poles 38 at a sleeve 41. The other end of this horizontal brace 42*a* (the left end in FIG. 5) is temporarily attachable to (assembled to) the inner pole 40 at a connection point 43. Similarly, one end of the horizontal brace 42*b* (also the right end in FIG. 5) is rotatably attached to the other of the outer poles 38 at another sleeve 41. In contrast, however, the other end of the horizontal brace 42*b* (also the left end in FIG. 5) is permanently attached to the inner pole 40 (see e.g., FIG. 4).

Generalizing, embodiments of the desk 10, such as desk 10*a*, may be set up and taken down in a few minutes by a single person. Thus it is suitable for travelling office work, e.g., for armies and motion picture location shooting. This sit-inside rotary desk approach provides an effective width for the desk 10 that is far wider than a conventional rectangular desk, extending the virtual size of the desk 10 to many feet (depending on the diameter of the particular model). Different models of the desk 10 can have different diameters. For example, a 4' hole in the middle gives an effective width for the desk 10 of 12.5 feet (4×pi), a 6' hole in the middle gives an effective width of nearly 19 feet (6×pi), etc. However, smaller models are also possible, and can be made small enough to fit into some office cubicles. Of course, to facilitate constructing such embodiments of the desk 10 with different diameters, or other goals, different quantities of sub-sections, uprights, and baseplates may be used.

The desk 10 has a number of advantages. It may be erected in minutes, or folded flat in minutes for storage or shipment. The user may sit in a fixed position. The user may even sit in a recliner, (although some rotation of the user's chair may be required to exit the desk 10). The user may exit in different directions, depending on where they turn the gap 26 in the desk 10. A computer may be provided in a fixed position outside of the desk 10, with its keyboard potentially remaining on the desk 10. The desk 10 may then be moved to any position without affecting the fixed computer, provided that a cordless mouse and keyboard are used, which can be moved to any part of desk 10.

The desk 10 has a few slight disadvantages. In some embodiments, an upright 30 may be exposed depending on the rotation of the desk 10, which might be considered unsightly (for instance, picture FIG. 1 with the top section 14 rotated 30 degrees clockwise or counterclockwise from what is shown there). There is also a fixed number of possible entrance/exit angles, and a user must step between fixed uprights 30 to get in or out (as shown by the entrance points 36 in FIG. 3).

FIGS. 6*a-b* are, respectively, a top perspective view and a partial bottom perspective view of a second embodiment of a desk 10*b* that is also in accord with the present invention. The desk 10*b* is also circular with a central hole 12 in the middle where a user sits, and also has a gap 26 through which a user enters and exits the desk 10*b*.

The desk 10*b* has a top section 14, which may be and here is the same as the top section 14 of the desk 10*a*. However, the desk 10*b* shown here, unlike the desk 10*a*, has a different support section 52 and essentially no base section.

FIG. 6*b* particularly shows details of the support section 52. It includes six pedestals 54, which each have three legs 56 ending with an upper wheel 58, as shown. Functionally, the pedestals 54 operate similarly to the uprights 30 of the desk 10*a*, that is, the top section 14 rotatably sits on the upper wheels 58.

As noted, FIGS. 6*a-b* show no base section. This is to emphasize that other options exist. For instance, the pedestals 54 may be heavily weighted, say, at the bases, to make them hard to move and thus keep them in place. Alternately, the pedestals 54 may be attached to a floor on which they rest. Yet alternately, a base section like the base section 18 (FIG. 1) may be used. The latter is the inventor's preferred approach, but FIGS. 6*a-b* show that other approaches are encompassed within the spirit of the present invention.

Continuing with features that are the inventor's preferences, which are not limitations, the flange 24 is the preferred method of retaining the top section 14 above the uprights 30 or the pedestals 54, but other approaches are possible. FIGS. 7*a-b* are a partial cross-sectional views showing examples. Here the sub-sections 20*a-c* may each have one or more grooves 60 provided on their under side, for the wheels 46 or the upper wheels 58 to ride in. The flange 24 is then optional. This approach has the disadvantage, however, in that the top section 14 needs to be thick enough that the groove 60 or grooves 60 are deep enough that the wheels 46 or the upper wheels 58 engage securely to retain the sub-sections 20*a-c* above the uprights 30 or the pedestals 54. Making the sub-sections 20*a-c* this thick tends to increase the weight and cost of the desk 10.

FIG. 8 is a partially exploded view of sub-section 20*a* of the desk 10, 10*a*, 10*b*. This particularly shows the inventor's preferred approach to attaching the flange 24 to the top section 14. Multiple hooks 70 (or pegs, etc.) are provided on the flange 24 to engage with corresponding support holes 72 in the sub-section 20*a* (and similarly with the other sub-sections 20*b-c*). At the end of the sub-section 20*a*, proximate to the gap 26 a hook hole 74 is provided to receive a catcher hook 76 at the end of the flange 24 (and similarly in the end of the sub-section 20*c* proximate to the gap 26).

Just as with many prior art desktops, the desks 10 here can also have color and texture options and be built with plastic snap-on covers to enclose photographs, frequently-used information, or for such overall across the entire desktop. One or more optional transparent parts can be provided in the sub-sections 20*a-c* to show computer monitor(s) that are placed below the top section 14, instead of or in addition to monitor(s) above the desk 10.

If desired, possibly on large embodiments of the desk 10, motors can be provided on the uprights or pedestals. Also possible, say, on larger embodiments of the desk 10, a removable center plug section can be provided in the central hole 12. This can be used for a computer monitor that is installed inside the desk 10.

The height of the uprights may also be variable, say, with snapable height choices. The height of the pedestals may also be similarly variable, albeit probably with a more complex mechanism needed due to the tripod-like shape of the pedestals.

While various embodiments have been described above, it should be understood that they have been presented by way of example only, and that the breadth and scope of the invention should not be limited by any of the above described exemplary embodiments, but should instead be defined only in accordance with the following claims and their equivalents.

What is claimed is:

1. A desk (10, 10*a*, 10*b*), comprising:

a top section (14) having a central hole (12) wherein a user of the desk may sit and a gap (26) where said user may enter into said central hole;

said top section is of a plurality of sub-sections (20*a-c*) assemble able such that said top section is substantially round and forms a top side whereupon objects may be placed on the desk;

a central section (16) including a plurality of uprights (30, 54) each having one or more wheels (46, 58) upon which said top section rotatably rests when the desk is assembled; and each said upright includes three poles (38, 40) each having a said wheel.

2. The desk of claim 1, wherein said plurality of sub-sections are attached together with cleats (22).

3. The desk of claim 1, wherein said plurality of sub-sections totals three said sub-sections.

4. The desk of claim 1, wherein two said sub-sections include endpieces (28) adjacent to said gap and that extend above the rest of the top section.

5. The desk of claim 4, wherein said endpieces extend along said gap to assist in holding objects placed on said top side of the desk from falling off the desk.

6. The desk of claim 4, wherein said endpieces are graspable by an adult human hand, to facilitate said top section of the desk being rotatably moved.

7. The desk of claim 1, said top section has an outer periphery, the desk further comprising:

a flange (24) at said outer periphery.

8. The desk of claim 7, wherein:

said flange is a single unitary piece.

9. The desk of claim 7, wherein:

said flange extends above the rest of the top section to assist in holding objects placed on the desk from falling off the desk.

10. The desk of claim 7, wherein:

said flange extends below the rest of the top section to retain said top section above said wheels and upon said plurality of uprights.

11. The desk of claim 1, wherein:

said top section includes at least one groove (60) in which said wheels partially engage, thereby retaining said top section on said wheels and above said central section when the desk is assembled.

12. The desk of claim 1, further comprising:

a base section (18) of a plurality of assemble able baseplates (32) that said plurality of uprights attach to and rest upon when the desk is assembled.

13. The desk of claim 12, wherein:

said plurality of baseplates are attached together with clamps (34).

14. The desk of claim 12, wherein:

said plurality of uprights are each hingeably attached to a said baseplate.

15. The desk of claim 14, wherein:

said uprights each include three legs forming a pyramidal shape having an apex, wherein said one or more wheels is a single wheel located at said apex.

16. The desk of claim 1, wherein:

said poles are held in a fixed relationship by diagonal braces (44) when the desk is assembled.

17. The desk of claim 1, wherein:

said poles are held in a fixed relationship by horizontal braces (42*a-b*) when the desk is assembled.

18. An improved desk (10, 10*a*, 10*b*) of the type in which:

a top section (14) includes one or more sub-sections (20*a*-*c*);

a central section (16) includes a plurality of uprights (30, 54) that support said sub-sections by said top section resting upon said central section; and a base section (18) includes a plurality of baseplates (32) that support said plurality of uprights of said central section;

the improvement comprising:

said top section has a central hole (12) wherein a user of the desk may sit and a gap (26) where said user may enter into said central hole, and wherein said one or more sub-sections (20*a*-*c*) provide said top section with a shape substantially round horizontally and with a top side whereupon objects may be placed on the desk;

said plurality of uprights in the central section each have one or more wheels (46, 58) upon which said top section rotatably rests when the desk is assembled; and each said upright includes three poles (38, 40) each having a said wheel.

* * * * *